US005522419A

United States Patent [19]

Sand

[11] Patent Number: 5,522,419

[45] Date of Patent: Jun. 4, 1996

[54] CHEMICAL EDUCTOR WITH INTEGRAL ELONGATED AIR GAP

[75] Inventor: William F. Sand, Cincinnati, Ohio

[73] Assignee: Hydro Systems Company, Cincinnati, Ohio

[21] Appl. No.: 494,420

[22] Filed: Jun. 26, 1995

[51] Int. Cl.[6] ..... B01F 5/04

[52] U.S. Cl. ..... 137/216; 137/888

[58] Field of Search ..... 137/216, 888, 137/892, 893, 895

[56] References Cited

U.S. PATENT DOCUMENTS 4,697,610 10/1987 Bricker ..... 137/216 X 5,159,958 11/1992 Sand ..... 137/888

5,253,677 10/1993 Sand ..... 137/888

*Primary Examiner*—Robert G. Nilson

*Attorney, Agent, or Firm*—Wood, Herron & Evans

[57] ABSTRACT

An improved venturi eductor for proportional dispensing of chemicals into flowing water includes a large anti-siphoning air gap section. The air gap section includes an outer wall and an inner wall with a gap between the walls. Both walls include offset vents or windows that provide an indirect path from the center of the air gap to the exterior of the eductor. The eductor is made from several molded parts that may be assembled without requiring machining. Further, eductor has a unique spray shield design that more effectively controls water splash in the eductor section and simplifies assembly.

26 Claims, 3 Drawing Sheets

CHEMICAL EDUCTOR WITH INTEGRAL ELONGATED AIR GAP

FIELD OF THE INVENTION

The present invention relates generally to a fluid handling device; and more particularly, to a fluid handling device that uses the flow of fluid from one inlet to aspirate a liquid chemical through another inlet and discharge the fluid mixture through an outlet.

BACKGROUND OF THE INVENTION

It is a common practice for chemicals such as those used for cleaning and sanitizing to be purchased as concentrated liquids. The chemicals are mixed with water to achieve the desired usage concentration. A variety of proportioning dispensers have been developed to achieve this. These dispense mixtures at use concentration. The dispensers often employ venturi-type devices sometimes called eductors to proportion the chemical and deliver this for use. Water traveling through the central portion of the venturi creates suction which draws the chemical into the water stream. The amount of chemical educted is controlled by a metering orifice in the chemical feed line.

The concentrations desired in this type of chemical dispensing varies greatly ranging from 1:1 to over 1:1000. The devices also must function with a wide range of water pressures, temperatures and dissolved minerals and gases. In some of these conditions, the eductor functions much like a classical flow venturi, while in other they are more like a jet pump. The devices are mechanically simple, generally without moving parts, but small details of the construction have important influence on their performance.

It is usually desirable to operate these dispensers with water provided directly from the public water supply. In this situation, the dispensers are subject to the regulations of the public water departments who are concerned about preventing any possibility of the chemical concentrates syphoning or flowing back into the water system. Venturi-type chemical eductors with an air gap for back siphoning protection for dispensing applications are disclosed in the Sand U.S. Pat. Nos. 5,253,677 and 5,159,958, both of which are assigned to the Assignee of the present invention. The essential geometry of a venturi is that of a constriction and then a downstream enlargement of a contained stream of fluid. According to Bernoulli's theory, suction is created at the point where the flow channel widens. The operation of the venturi requires that the entering fluid stream have a certain amount of flow energy. For an air gap eductor, this means that the stream must cross the air gap and enter the venturi while developing an appreciable pressure within the entrance of the venturi.

The geometry which creates this function includes an inlet orifice for directing a first fluid, for example, water, that has a diameter larger than the smallest orifice within the eductor venturi. The eductor venturi includes a larger diameter mixing chamber downstream of the smallest venturi orifice. A second fluid, for example, a liquid chemical, is pulled by suction through a second inlet into the mixing chamber and mixed with the first fluid. A venturi diffuser extends from the mixing chamber and flares outwardly to conduct the mixture of the first and second fluids, that is, the water and the chemical to an eductor outlet. A spray shield is located between the eductor air gap and the eductor venturi and blocks spray from reentering the air gap.

While the above chemical eductors work satisfactorily, there are several disadvantages to their designs. First, under some circumstances, current spray shield designs, may not optimally direct spray or collected water. Further, current spray shield designs require that the periphery of the spray shield have a water tight connection with the internal walls of the eductor body. That construction requirement adds complexity and cost to the process of manufacturing the eductor. In addition, the designs of current eductors are complex. The dimensional tolerances are relatively small, and the components of the chemical eductor require machining. The machined components are then assembled by welding, adhesives or other techniques to form the eductor. Therefore, the manufacture of the chemical eductor requires expensive capital equipment and highly skilled labor, and further, is complex and time consuming, all of which adds substantial cost to the eductor unit.

SUMMARY OF THE INVENTION

Accordingly, it is an object of the present invention to provide a chemical eductor having a simplified design which provides an improved performance and which can be manufactured by assembling several molded components which require little or no machining.

According to the principles of the present invention and in accordance with the described embodiments, the present invention provides a chemical eductor for mixing two fluids that includes a hollow body member having a generally square cross-section extending longitudinally into the body member. An inlet fluid orifice having a predetermined diameter is located at one end of the hollow body member and receives a first fluid, for example, water, from a fluid source. The eductor further has an integral air gap within the generally square cross-section of the hollow body member that receives fluid from the inlet fluid orifice.

In another embodiment of the invention, the hollow body has an air vent in an outer wall thereof, and an arcuate wall section is located within the hollow body member and shields the air vent. In another aspect of the invention, the arcuate wall section is spaced away from a circumference of the inlet fluid orifice a radial distance equal to no less than four of the predetermined diameters of the fluid inlet orifice.

In a further embodiment of the invention, a spray shield located within the hollow body member between the integral air gap and the eductor section has a spray shield orifice receiving the first fluid from the integral air gap. The spray shield has a spray shield surface that extends along the central longitudinal axis and slopes away from the spray shield orifice toward the eductor orifice. The spray shield surface substantially blocks the first fluid in the eductor section from reentering the air gap. The spray shield design has the advantage of facilitating water flow through the eductor.

In a still further embodiment of the invention, the eductor includes a cap that is permanently coupled to the hollow body member. The cap is adapted at one end to be connected to the fluid source, and the cap has a connector on its opposite end that is sized and shaped to fit within the hollow body member. Either one of the side wall or the connector has a tab extending laterally therefrom within the hollow body member, and, the other of the side wall or the connector has a notch sized and shaped to receive the tab. The tab has a first position not engaged with the notch whereby the cap can be moved axially into the hollow body member. The tab has a second position engaged with the notch to form a mechanical lock between the tab and the notch that prevents the cap from moving in any direction with respect to the hollow body member. The component parts of the eductor require little or no machining, and have the advantage of being quickly assembled, either manually or with automatic assembly equipment.

The objects and advantages of the present invention will be further appreciated in light of the following detailed description and drawings.

DETAILED DESCRIPTION

Figure 1:
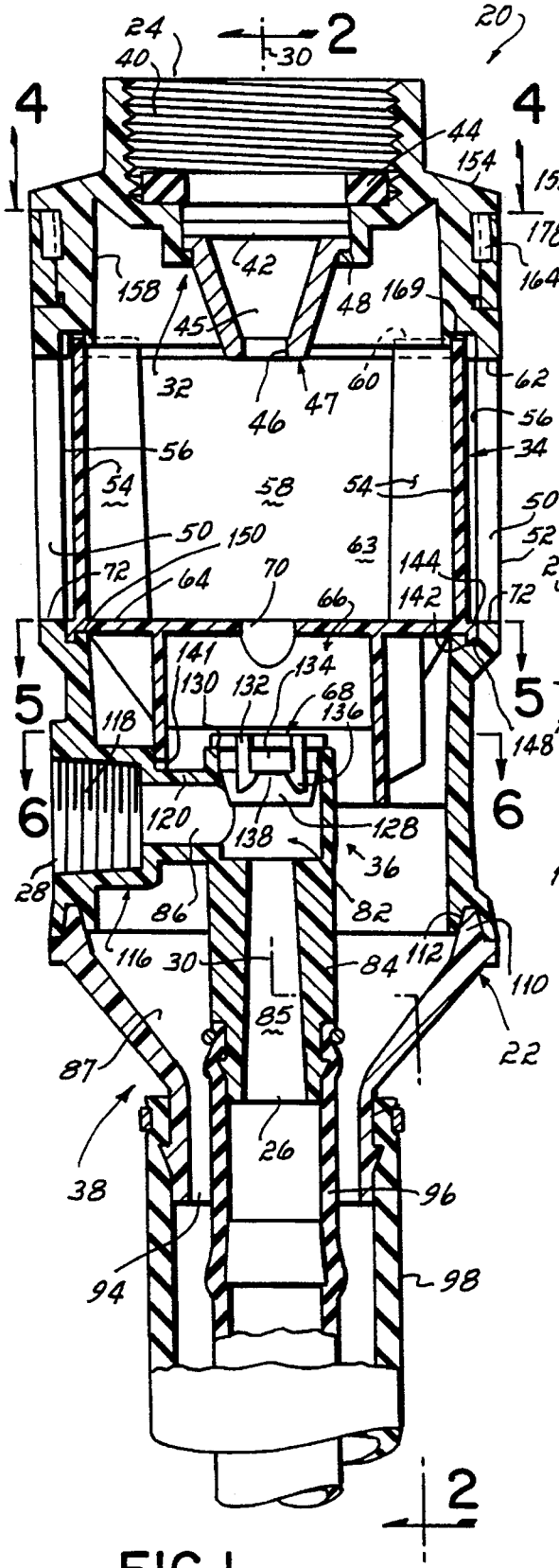
FIG. 1 is a centerline cross-sectional view of an eductor in accordance with he principles of the present invention.
Figure 2:
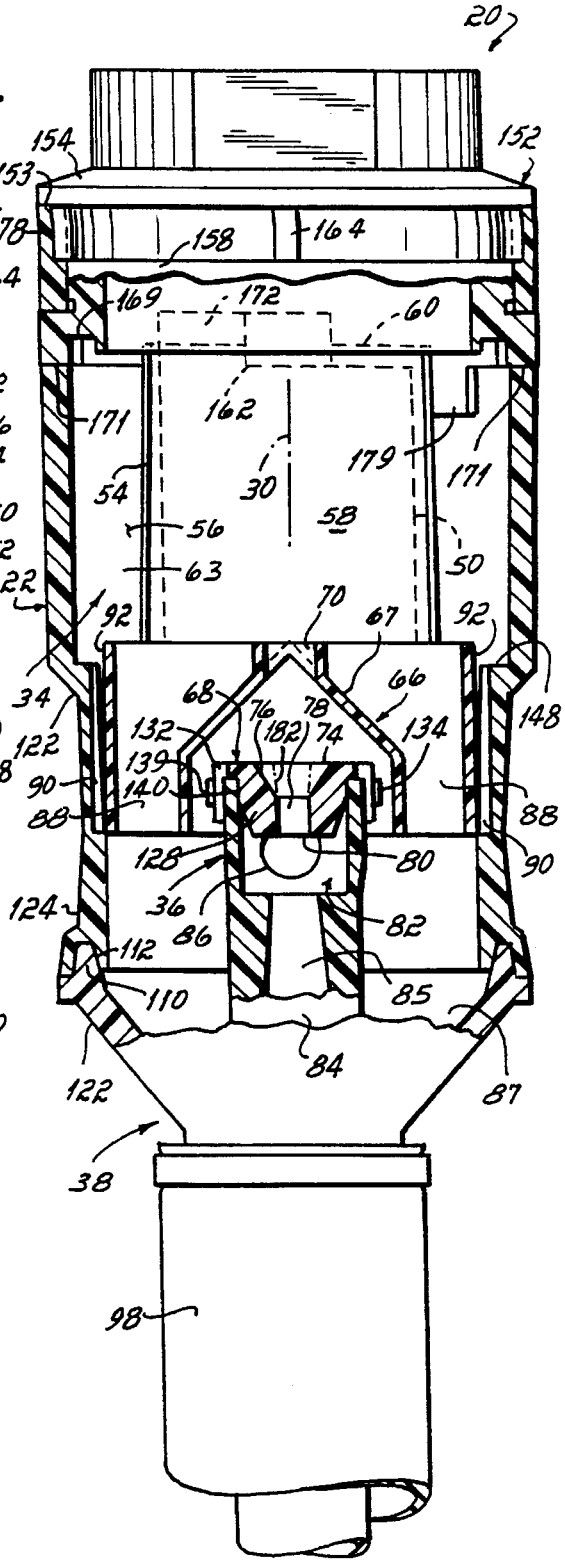
FIG. 2 is an axial cross-sectional view taken along line 2—2 of FIG. 1.

Referring to FIGS. 1 and 2, a chemical eductor 20 includes an outer body 22 having an upstream first fluid or liquid inlet 24, a second fluid or liquid inlet 28 and a downstream fluid or liquid outlet 26. The first liquid, for example water, flows along a central axis 30 of the eductor 20 through an inlet section 32, through an intermediate section 34, through an eductor section 36, and into a collector section 38. The inlet section 32 includes a threaded coupling 40 adapted to screw onto a liquid source, for example, a water supply valve (not shown). Downstream of the coupling 40 is a flow stabilizer, for example, a set of strainers, 42 which are under a washer 44. The flow stabilizer serves to help the inlet section 32 deliver a dense, columnar stream of water therethrough. The inlet section 32 also has a flow passage 45 that is tapered and preferably has the shape of an inverted frustum. The flow passage 45 terminates at orifice 46 which is centered on the axial flow path and the central axis 30. Preferably the passage 45 and orifice 46 are formed by a brass nozzle 47 which is located within the bore 48 of the inlet section 32.

Downstream of the inlet section 32 is the intermediate section 34 which includes two, opposed generally square-shaped windows or vents 50 which extend through the outer wall 52 of the outer body member 22. Two generally opposed walls 54 are symmetrically located about the central axis 30 and are displaced a predetermined distance, for example, approximately 0.190 inches from an inner surface 56 of the outer wall 52. The walls 54 function as baffles in front of the vents 50; and therefore, the walls or baffles 54 are positioned to shield the vents 50. The walls 54 are sized to extend laterally beyond and overlap the sides of the vents 50. The baffles 54 have upper edges 60 that overlap and extend above the upper edge 62 of the vents 50. The lateral edges of the baffles 54 border second openings or vents 63 which are located between the first vents 50, thereby providing an indirect path for air circulation through the vents 50, behind the baffles 54, through the second openings 63, and into the air gap 58. The air gap 58 is the vertical separation between the bottom of the nozzle 47 and the bottom edge 74 of the vents 50. The air gap 58 is preferably approximately one inch. The lower ends of the walls 54 are connected to a base 64 that supports the walls 54 within the outer body member 22.

The base 64 also supports a spray shield 66 which has sloped sides 67 oblique to the centerline 30 and longitudinal sides parallel to the centerline 30. The spray shield 66 along with the base 64, extend downward through the outer body member 22 to overlap and partially cover the inlet orifice 74 of the eductor section 36. Water flows through the orifice 46 of the inlet section 32, through the intermediate section 34, through an orifice 70 in the spray shield 66 and into the eductor section 36. In the event that there is a pressure differential creating a siphoning effect through the inlet section 32, the intermediate section 34 functions to permit air to flow through the first vents 50, around the walls 54, through the second openings 63 and through the orifice 46, thereby preventing fluid below the air gap 58 from flowing back through the orifice 46 and out the fluid inlet 24.

Figure 6:
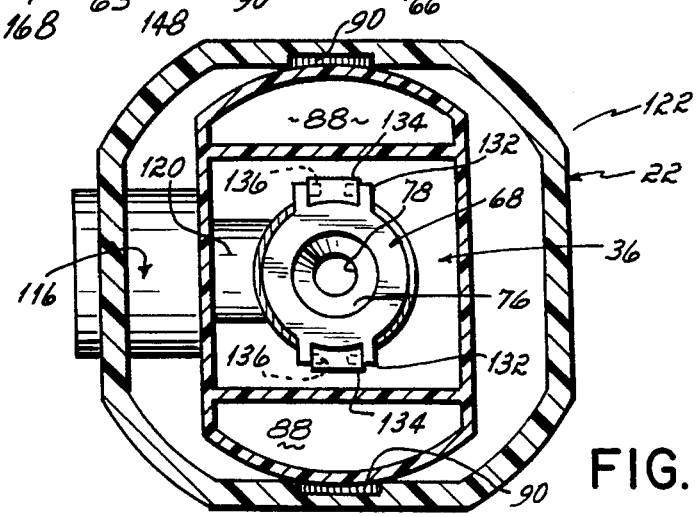
FIG. 6 is an overhead cross-sectional view taken along line 6—6 of FIG. 1.

Referring to FIGS. 1, 2, and 6, The eductor section 36 includes an eductor insert 68 that has an eductor inlet orifice 74 downstream of the orifice 70. The eductor insert 68 further includes a fluid passage 76 that preferably has tapered side walls that have an inverted frustoconical shape. The fluid passage 76 leads downstream into a generally cylindrical flow passage 78 that terminates at an eductor orifice 80 from which water flowing through the eductor insert 68 is discharged. The eductor insert 68 extends to a fluid mixing chamber 82 that is connected to a diffuser tube 84.

The eductor section 36 functions generally as a venturi, so that as water passes through the restricted passage 78 and eductor orifice 80, through the chamber 82 and into the flared diffuser flow path 85, there is a pressure reduction or suction effect within the chamber 82 that is effective to pull a second liquid, for example, a chemical concentrate, through the second inlet 28, the feed passage 86 and into the mixing chamber 82. The chemical and water are mixed in the mixing chamber 82 and discharged through the flared diffuser flow path 85 of the diffuser tube 84.

The collection section 38 which is downstream of the eductor section 36 includes a collection cavity 87 which is connected by first bypass, or drainage flow path 88 that extends through the base 64 into the air gap 58. A second, generally parallel, drainage flow path 90 extends between the air gap 58 and the collection cavity 87 along an area defined by an outer surface 92 of the base 64 and inner surface 56 of the outer member 22. The water that does not flow through the mixing chamber 82 flows along drainage paths 88, 90, through the collection cavity 87 and into a generally cylindrical passage 94 defined between an outer surface of a tubular extension 96 that is connected to the outlet of the eductor section 36 and a discharge tube 98 connected to the outlet 26 of the eductor 20. The water and chemical mixture flowing through the eductor section 36 mixes with the water flowing through the collection cavity 87 and the discharge tube 98.

Figure 3:
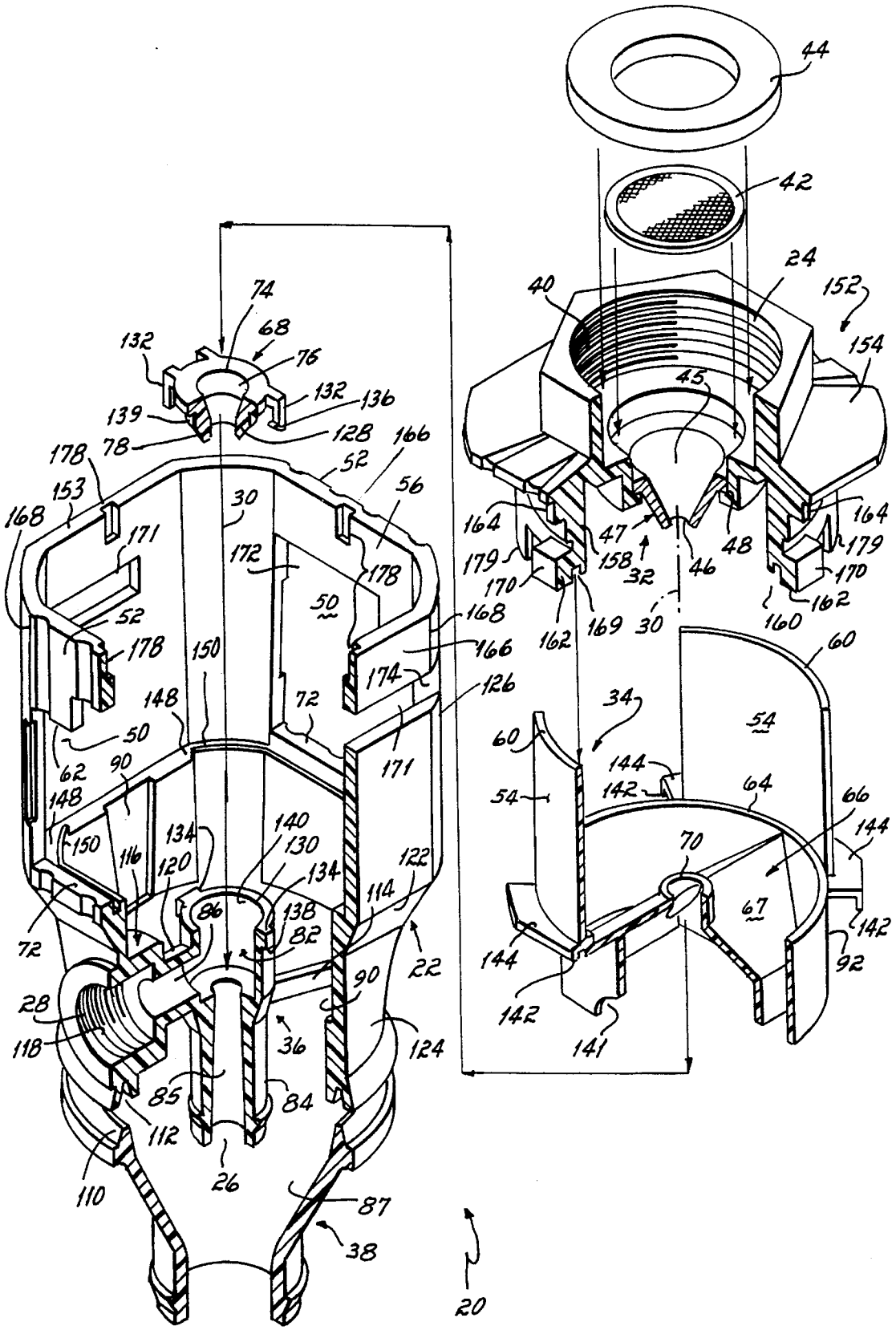
FIG. 3 is a disassembled view of component parts of the eductor.

Referring to FIG. 3, in its preferred embodiment, the eductor 20 is comprised of several molded parts that do not require machining, and that may be quickly assembled, either manually or with automatic assembly equipment. In the preferred construction, the first molded part is the collection section 38 which has a flange 110 directed upward and longitudinally with respect to the collection section 38. A second molded part of the eductor is the generally hollow body member 22 that has an annular groove 112 on a lower end thereof which is sized and shaped to receive the flange 110. The collection section 38 may be attached to the lower end groove 112 of the outer body 22 by spin welding, adhesives, or other known connecting mechanisms. Molded with the outer body 22 is the mixing chamber 82 and flared diffuser tube 84 of the eductor section 36. The eductor section 36 is supported in a central location within the outer body 22 by molded struts 114 and tubular section 116 that includes a coupling 118 contiguous with the chemical inlet 28 and a pipe section 120 containing the chemical inlet passage 86. The outer body 22 also has a transitional section 122 that flares outwardly from the generally cylindrical lower end 124 to a multi-lateral wall section 126 at the upper end of the outer body 22.

A third molded part of the eductor 20 is the eductor insert 68 which has a lower portion 128 that is inserted through the upper opening 130 leading to the mixing chamber 82. Referring to FIGS. 1 and 6, the eductor insert 68 is oriented and located such that pairs of spaced arms 132 on opposite sides of its lower portion 128 slide down the lateral sides of alignment tabs 134 molded on opposite sides of the eductor section 36. The resilient arms 132 have projections 136 at their outer directed ends. The arms 132 spread apart as the projections 136 slide along the sides of the alignment tabs 134. The arms then come together and lock the projections 136 onto lower surfaces 138 of the tabs 134. Therefore, by sliding the eductor inlet into the mouth 130 as just described, the locking actions of the projections 136 secure and attach the eductor insert 68 to the eductor section 36. Further, the lower portion 128 of the eductor insert 68 has an annular ring 139 on its outer surface which frictionally engages the inner cylindrical surface 140 in an interference fit, thereby tightly securing the eductor insert 68 into the eductor section 36. If desired adhesives may also be used to more permanently secure the eductor insert into the eductor section 36.

Referring to FIG. 3, the intermediate section 34 of the eductor 20 is formed by a fourth molded part and is preferably molded from a clear plastic material. The intermediate section 34 is oriented such that the arcuate cutout 141 is aligned with the tubular section 116. The intermediate section 34 is then axially inserted past the multi-lateral walls 126 of the outer body 22 until lip edges 142 on the radially extending flanges 144 bear against a locating surface 148 within the outer body 22. The locating surface 148 is in a plane generally perpendicular to the central axis 30. The lip edges 142 are further located behind wall projections 150 which extend in an axial direction above the locating surface 148 over a distance that is generally in front of the vents 50. Further, the arcuate cutout 141 comes to rest immediately above the pipe section 120.

The assembly of the eductor 20 is completed by attaching a molded cap 152 to the upper end 153 of the outer body 22. The cap has a cover plate 154 which is located adjacent the lower side of the threaded coupling 40. The cover plate 154 is sized and shaped to cover the open upper end 153 of the outer body 22 when the cap 152 is attached thereto. The cap 152 further includes a generally cylindrical, tubular lower body 158 having a lower edge 160 extending below the orifice 46. The lower body 158 also has four equally spaced, radially projecting first tabs 162. Preferably, the first tabs 162 are generally rectangularly shaped and located adjacent the bottom edge 160 of the cylindrical body 158. In addition, the cap 152 contains four equally spaced and radially projecting second tabs 164 which are also preferably rectangularly shaped. Further, the tabs 164 are preferably located adjacent the upper edge of the tubular lower body 158, and further, the tabs 164 are preferably aligned with the center of the circumferential length of the first tabs 162.

The multi-lateral section 126 of the outer body 22 has a generally square-shaped cross section and includes four generally identical sides 166 which are oriented at right angles to each other. The sides 166 are joined along their lateral edges to corner walls 168. To attach the cap 152 to the outer body 22, the cap 152 is oriented such that the first tabs 162 are located immediately adjacent the corner walls 168. The distance between the outer surfaces 170 of opposing first tabs 162 are slightly less than the distances separating the opposing corner walls 168. Therefore, the cap 152 can be slid axially into the outer body 22 until the lower surface of the cover plate 154 covers the upper end 153 of the outer body 22 which is contiguous with the upper edges of the side walls 166 and corner walls 168. As the cap 152 slides axially into the outer body 22, the upper edges 60 of the walls 54 slide into an annular groove 169 in the lower edge 160 of the lower body 158. When the cap is properly inserted into the outer body 22, two of the opposed first tabs 162 are aligned with first openings or slots 171 located in opposite side walls 166. In addition, the other two opposed first tabs 162 are aligned with upper portions 172 of the two opposed vents 50. It should be noted that commonly directed or oriented ends of the slots 171 and open portions 172 of vents 50 extend to commonly oriented lateral edges or sides 174 of the end walls 168.

Figure 4:
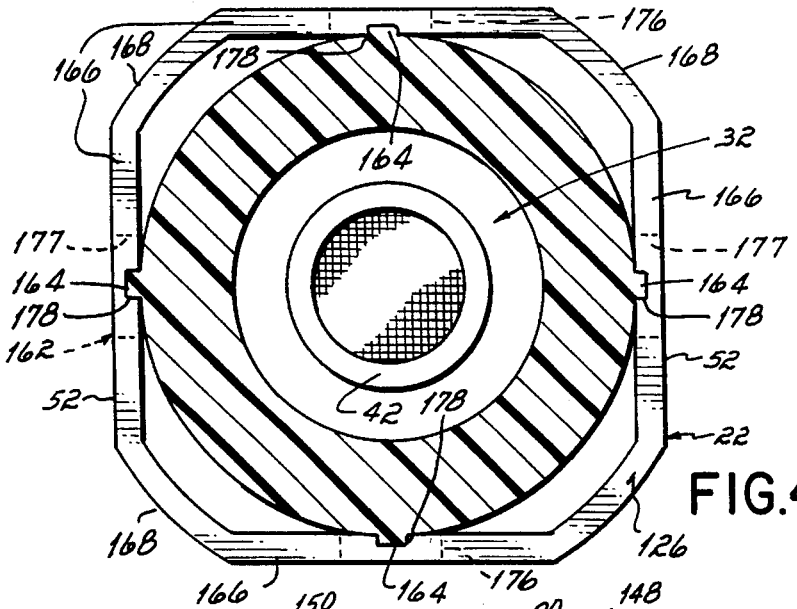
FIG. 4 is an overhead cross-sectional view taken along line 4—4 of FIG. 2.

The end cap 152 is then rotated about the centerline 30 in a clockwise direction as viewed in FIGS. 3 and 4. Rotating the cap 152 engages one pair 176 of the opposed first tabs 162 centrally within the slots 171. In addition, the opposite pair 177 of first tabs 162 enter the open portions 172 of the vents 50. The clockwise rotation of the cap 152 is continued until the four second tabs 164 engage four notches 178 which restrains and locks the cap 152 from rotation in either the clockwise or the counterclockwise directions. Further, the engagement of the first tabs 162 in the slots 171 and the open portions 172 of the vents 50 prevents the cap from being moved axially with respect to the outer body 22. Therefore, the cap 152 is mechanically and permanently locked within its desired position within the outer body 22 of the eductor 20. When locked in position, the cap 152 has two shields 179 to keep water from exiting from the slots 171 and to protect the orifice 46.

The molded parts just described have the advantage of being easily assembled into the functioning eductor 20 without requiring complex and expensive machining of the molded parts. Therefore, the eductor 20 has the advantage of being easier and less expensive to manufacture. Further, as shown in the cross section of FIG. 4, which is taken through the upper end of the assembled cap 152 as shown in FIG. 1, the interlocking tabs 162, 164 and slots 171, 178 provide a permanent assembly which cannot be disassembled or tampered with without destroying the functionality of the eductor.

Figure 5:
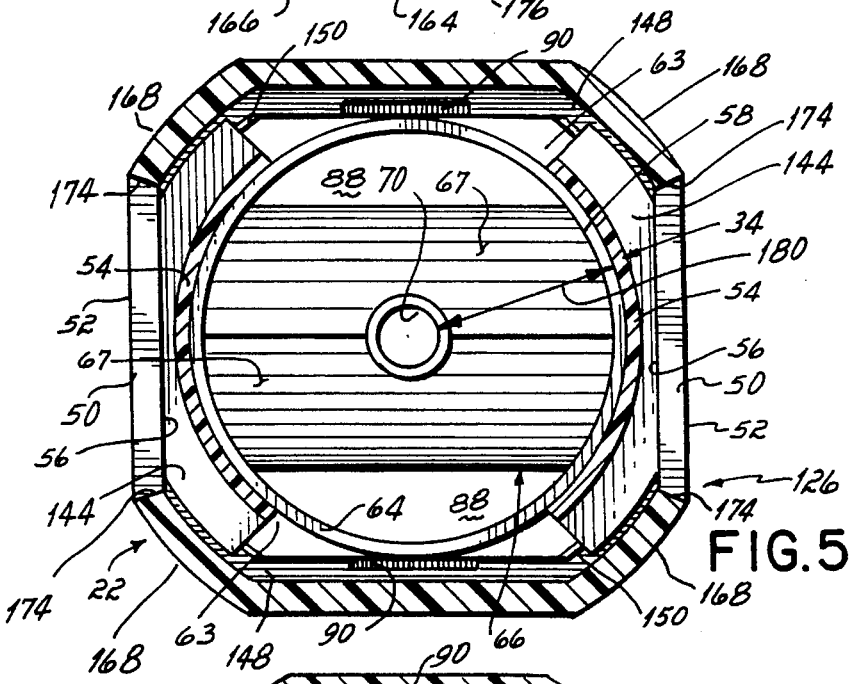
FIG. 5 is an overhead cross-sectional view taken along line 5—5 of FIG. 1.

As shown in the cross section of FIG. 5, the generally square cross section of the multilateral body section 126 provides for a generally cylindrical air chamber section 34 to be mounted therein. Further, the generally square cross section of the outer body 22 permits the eductor to be retrofit in most applications in the same location as prior cylindrical eductors. The generally square cross section of the outer body 22 further permits a larger spacing between the orifice 46 and the baffles or walls 54. For example, preferably, the radial distance 180 between the circumference of the orifice 46 and the walls 54 is approximately equal to four diameters of the largest size of the orifice 46. Prior designs limited the radial distance 180 of the intermediate section to be equal to three diameters of the orifice 46. The generally square cross section of the outer body 22 has the further advantage of providing larger drainage passages 88 (FIG. 2) within the intermediate section 34 and outside the spray shield 66. In addition, the design has the advantage of larger drainage passages 90 (FIG. 5) between the outside of the base member 64 and the inside surface 56 of the outer body 22. The engagement of the upper edges 60 of the walls 54 in groove 169 helps prevent water in the air gap 58 from splashing out through the vents 50.

As a further feature of the invention, the spray shield 66 extends around and down past the eductor inlet orifice 74 of the eductor insert 68. Therefore, water flowing through the orifice 70 of the spray shield 66 that splashes off of the surfaces within the eductor section 36 is directed downward into the collection cavity 87. The surfaces of the spray shield 66 slope downward from the orifice 70 thereby providing gravity drainage of water from the surfaces of the spray shield into the collection cavity 87. The design of the spray shield 66 minimizes the probability of water reentering the air gap 58 and has the further advantage in that the joint formed between the lip edge 142 and the locating surface 150 is not required to be watertight as with prior designs.

While the invention has been set forth by a description of the illustrated embodiment in considerable detail it is not intended to restrict or in any way limit the claims to such detail. Additional advantages and modifications will readily appear to those who are skilled in the art. For example, the various components illustrated in FIG. 3 are preferably molded from plastic materials which have the characteristics of being chemically resistant, compatible with water and thermally stable. The outer body section 22 and collection section 38 are preferably injection molded from a polypropylene plastic resin. The intermediate section 34 is preferably molded from a styrene acrylonitrice resin and the cap 152 is preferably molded from an acetal resin. Other plastic resins may also be used to manufacture the various components.

Further, as will be appreciated, variations in the designs of the molded components may be implemented without varying from the principles of the present invention. For example, the brass nozzle 47 may be replaced by a nozzle section in which the flow passage 45 and orifice 46 are molded into the inlet section 32 of the cap 152. As will be appreciated, the sizes and shapes of various pieces, for example, tabs 162, 164 and mating openings 171, 172 may be varied without changing their function. In addition, the geometric shape of components may be dictated by the molding process. For example, the lateral edges of the baffle walls 54 are tapered slightly from the base 64 to their upper edge 60. That taper is provided to facilitate the removal of the molded intermediate section component 34 from the part molds. Also, the lip edge 142 on the flange 144 and the wall extension 150 may be eliminated; and with other minor dimensional variations, the positioning flange 44 will then directly bear against the locating surface 148 to position the molded component comprising the intermediate section 34 within the outer body 22.

In addition, the extent to which the walls of the spray shield 66 extend below the eductor inlet orifice 74 of the insert 68 is a matter of design choice. The spray shield 66 should minimally block any direct line between surfaces on the eductor section 36 and the air gap 58, so that water splashing off of the air duct section 36 cannot reenter the air gap 58. Further, the downward sloping surfaces of the spray shield from the orifice 70 of the spray shield 66 may be rectangular, conical, or other shape, and may slope at different angles.

Further, The number and locations of the vents 50 and baffle walls 54 may also be varied without deviating from the principles of the present invention. The construction of the adaptor as previously described provides an eductor with excellent flow, drainage and eduction characteristics and is suitable for a majority of situations. However, in some situations it is preferred that the baffles 54 and/or the spray shield 66 not be used. Simply removing the spray shield 66 and the baffles 54 would result in excessive spray passing through the windows 50 to the outside of the eductor 20. Therefore, other changes must be made to reduce the spray. It has been discovered that reducing the included angle between the side walls of the tapered flow passage 76 of the eductor insert 68 of FIG. 2 substantially reduces the spray. Further, it has been discovered if the included angle between the side walls of the tapered flow passage 76 is in the range of from approximately 5° to approximately 25°, as schematically shown at 182 in FIG. 2, the baffles 54 may be removed and not used with the spray shield 66. In addition, depending on the water pressures, the air in the water, etc, in some situations, the reduced angle frustoconical eductor insert 68 may allow the spray shield 66 and the baffles 54 to be not used and eliminated from the eductor assembly without there being excessive spray escaping from the windows 50 of the eductor 20. The invention, therefore, in its broadest aspects is not limited to the specific details shown and described. Accordingly, departures may be made from such details without departing from the spirit and scope of the invention.

What is claimed is:

1. An eductor for mixing a first fluid flowing through a first inlet with a second fluid aspirated from a second inlet and discharging mixed first and second fluids through an outlet, the eductor comprising:

a hollow body having a generally square cross-section at one end of the hollow body, the hollow body having the first inlet at the one end and the outlet at an opposite end;

an inlet fluid orifice located within the hollow body for receiving the first fluid from the first inlet;

an integral air gap within the hollow body receiving the first fluid from the inlet fluid orifice; and an eductor section located within the hollow body and including a mixing chamber and an eductor orifice receiving the first fluid from the integral air gap, the eductor section drawing the second fluid through the second inlet, into the mixing chamber and mixing the first and the second fluids in response to the first fluid flowing through the eductor section.

2. The eductor of claim 1 wherein the hollow body further comprises:

an opening extending through a wall of the hollow body at the one end; and an arcuate wall section located within the hollow body a predetermined distance from the opening and shielding the opening.

3. An eductor for mixing a first fluid flowing through a first inlet with a second fluid aspirated from a second inlet and discharging mixed first and second fluids through an outlet, the eductor comprising:

a hollow body having a central longitudinal axis, the first inlet at one end and the outlet at an opposite end;

an inlet fluid orifice located within the hollow body for receiving the first fluid from the first inlet;

an integral air gap located within the hollow body and receiving the first fluid from the inlet fluid orifice at one end of the integral air gap, an eductor section located within the hollow body and including a mixing chamber and an eductor orifice in fluid communication with an opposite end of the integral air gap, the eductor section drawing the second fluid through the second inlet, into the mixing chamber and mixing the first and the second fluids in response to the first fluid flowing through the eductor section; and a spray shield located within the hollow body between the integral air gap and the eductor section, the spray shield having a spray shield orifice receiving the first fluid from the opposite end of the integral air gap, and a spray shield surface sloping from the spray shield orifice toward the eductor section and away from the central longitudinal axis, the spray shield surface substantially blocking the first fluid from re-entering the integral air gap after passing through the spray shield orifice.

4. The eductor of claim 3 wherein the spray shield surface terminates at a longitudinal position within the hollow body substantially no closer to the spray shield orifice than the eductor inlet orifice within the eductor section.

5. The eductor of claim 4 wherein the spray shield surface terminates at a longitudinal position within the hollow body closer to the outlet of the eductor than the eductor inlet orifice.

6. The eductor of claim 3 wherein the spray shield surface includes a generally rectangular planar surface.

7. The eductor of claim 3 wherein the spray shield provides a generally rectangular volume below the spray shield orifice and above the eductor inlet orifice.

8. An eductor for mixing a first fluid flowing through a first inlet with a second fluid aspirated from a second inlet and discharging mixed first and second fluids through an outlet, the eductor having an air gap to prevent a backflow of fluids through the first inlet, the eductor comprising:

a hollow body including a notch adjacent one end;

a cap having a tab extending laterally from the cap and sized and shaped to fit within the notch in the hollow body;

the hollow body having a shape permitting the cap to be moved axially into the hollow body to a first position where the tab does not engage the notch; and the hollow body and the cap forming a mechanical lock between the cap and the hollow body in response to the cap being moved to a second position with respect to the hollow body.

9. The eductor of claim 8 wherein the mechanical lock prevents the cap from moving in any direction with respect to the hollow body.

10. The eductor of claim 9 wherein the cap further comprises:

a coupling at one end adapted to be connected to a fluid source; and a connector on an opposite end including the tab.

11. The eductor of claim 10 wherein the connector has first and second tabs extending laterally therefrom.

12. The eductor of claim 11 wherein the hollow body has first and second notches sized and shaped to receive the first and second tabs, respectively.

13. The eductor of claim 12 wherein the hollow body has a shape permitting the connector of the cap to be moved axially into the hollow body to the first position where the first and second tabs are not engaged with the first and second notches, respectively.

14. The eductor of claim 13 wherein the first notches in the hollow body and the first tabs on the connector of the cap form a first mechanical lock between the cap and the hollow body in response to the cap being moved to the second position with respect to the hollow body, the first mechanical lock preventing the cap from moving axially with respect to the hollow body.

15. The eductor of claim 14 wherein the second notches in the hollow body and the second tabs on the connector of the cap form a second mechanical lock between the cap and the hollow body in response to the cap being moved to the second position with respect to the hollow body, the second mechanical lock preventing the cap from rotating with respect to the hollow body.

16. The eductor of claim 11 wherein the first and second tabs are located longitudinally adjacent each other with respect to the cap.

17. The eductor of claim 16 wherein the cap further has a flange extending laterally from the cap and sized to cover a cross-section of the one end of the hollow body.

18. The eductor of claim 12 wherein the hollow body further includes a plurality of side walls forming a cavity having a generally square cross-section.

19. The eductor of claim 18 wherein the connector is generally cylindrically shaped and the first tabs include a pair of opposed tabs extending laterally from a generally cylindrical surface of the connector.

20. The eductor of claim 19 wherein the generally square cross-sectional area has a diagonal corner sized and shaped to receive the pair of opposed first tabs.

21. The eductor of claim 20 wherein the first notches in the hollow body include a pair of opposed first notches sized and shaped to receive the pair of opposed first tabs.

22. The eductor of claim 21 wherein the connector includes a pair of opposed second tabs extending laterally from the generally cylindrical surface of the connector.

23. The eductor of claim 22 wherein the second notches in the hollow body include a pair of opposed second notches sized and shaped to receive the pair of opposed second tabs.

24. The eductor of claim 8 further comprising:

an integral air gap located within the hollow body; and an eductor section located within the hollow body and including a mixing chamber and an eductor orifice receiving the first fluid from the integral air gap, the eductor section drawing a second fluid through the second inlet, into the mixing chamber and mixing the first and the second fluids in response to the first fluid flowing through the eductor section.

25. An eductor for mixing a first fluid from a first inlet with a second fluid from a second inlet and discharging mixed fluids through an outlet, the eductor having an air gap to prevent a backflow of the liquids through the first inlet, the eductor comprising:

a hollow body;

a cap having a connector on one end sized and shaped to fit within the hollow body;

one of the hollow body and the cap having a tab extending laterally therefrom and another of the hollow body and the cap having a notch sized and shaped to receive the tab;

the other of hollow body and the cap having a size and shape permitting the cap to be moved axially within the hollow body to a first position where the tab does not engage the notch; and the hollow body and the cap having a second position engaging the tab with the notch to form a mechanical lock between the tab and the notch, the mechanical lock preventing the cap from moving in any direction with respect to the hollow body.

26. An eductor for mixing a first fluid flowing through a first inlet with a second fluid aspirated from a second inlet and discharging mixed first and second fluids through an outlet, the eductor comprising:

a hollow body having a central longitudinal axis and the first inlet at one end and the outlet at an opposite end of the hollow body;

an inlet fluid orifice located within the hollow body for receiving the first fluid from the fluid inlet;

an integral air gap located within hollow body and receiving the first fluid from the inlet fluid orifice; and an eductor section located within the hollow body and including a mixing chamber and an eductor orifice receiving the first fluid from the integral air gap, the eductor section drawing the second fluid through the second inlet, into the mixing chamber and mixing the first and the second fluids in response to the first fluid flowing through the eductor section, the eductor section including a flow passage having an eductor inlet orifice and side walls tapering from the eductor inlet orifice to an eductor orifice, the side walls forming an included angle in a range of from approximately 5° to approximately 25°.

* * * * *